US011029034B2

(12) United States Patent
Lin

(10) Patent No.: US 11,029,034 B2
(45) Date of Patent: Jun. 8, 2021

(54) LOCKING MECHANISM AND COOKING MACHINE

(71) Applicant: PANASONIC APPLIANCES MICROWAVE OVEN (SHANGHAI) CHINA CO., LTD., Shanghai (CN)

(72) Inventor: Sien Lin, Shanghai (CN)

(73) Assignee: PANASONIC APPLIANCES MICROWAVE OVEN (SHANGHAI) CHINA CO., LTD., Shanghai (CN)

( * ) Notice: Subject to any disclaimer, the term of this patent is extended or adjusted under 35 U.S.C. 154(b) by 176 days.

(21) Appl. No.: 16/277,226

(22) Filed: Feb. 15, 2019

(65) Prior Publication Data

US 2019/0264925 A1 Aug. 29, 2019

(30) Foreign Application Priority Data

Feb. 23, 2018 (CN) ..... 201810155672.8

(51) Int. Cl.
*F24C 15/02* (2006.01)
*E05B 63/24* (2006.01)
*E05B 9/08* (2006.01)

(52) U.S. Cl.
CPC ..... *F24C 15/022* (2013.01); *E05B 9/08* (2013.01); *E05B 63/248* (2013.01)

(58) Field of Classification Search
CPC ... F24C 15/022; A63B 21/225; A63B 22/001; A63B 21/00069; A63B 21/00076; A63B 21/0051; A63B 21/0435; A63B 2208/0238; A63B 2220/17; A63B 2220/20; A63B 2220/51; A63B 2230/06; A63B 22/0056; A63B 22/0087; A63B 22/0605; A63B 22/0664; A63B 23/0222; A63B 23/03583; E05B 2047/0069; E05B 45/06; E05B 47/0012; E05B 47/06; E05B 49/00; E05B 11/00; E05B 15/1614; E05B 17/0025; E05B 17/0029; E05B 17/10; E05B 17/2034; E05B 17/208; E05B 17/22; E05B 2047/0048; E05B 2047/0058; E05B 2047/0061; E05B 2047/0067; E05B 2047/0068; E05B 2047/0084; E05B 2047/0094;
(Continued)

(56) References Cited

U.S. PATENT DOCUMENTS 4,006,121 A * 2/1977 Isono ..... E05C 19/024 200/61.64
6,102,689 A * 8/2000 Man ..... F23Q 2/164 431/153

* cited by examiner

*Primary Examiner* — Jason Lau
(74) *Attorney, Agent, or Firm* — David D. Brush; Westman, Champlin & Koehler, P.A.

(57) ABSTRACT

A locking mechanism and a cooking machine are provided for home appliances. The locking mechanism is provided on a control panel of the cooking machine and used to control the door-opening button of the cooking machine. The door-opening button is provided with a door-opening member for opening the door of the cooking machine. The locking mechanism switches the door-opening button selectively in a locked state or an unlocked state; the door cannot be opened even if the door-opening button is pressed in the locked state, and the door can be opened if the door-opening button is pressed in the unlocked state. The locking mechanism provided by the present invention is small in size and good in versatility, and can lock the door fundamentally in the door-opening operation, thus realizing simpler and more effective protection and hence ensuring use safety of users especially the children.

8 Claims, 6 Drawing Sheets

(58) Field of Classification Search
CPC ..... E05B 2047/0097; E05B 29/00; E05B 35/008; E05B 39/005; E05B 47/00; E05B 47/0001; E05B 47/0603; E05B 47/0615; E05B 47/0673; E05B 63/00; E05B 63/0013; E05B 63/0056; E05B 63/185; E05B 65/001; E05B 65/0014; E05B 65/006; E05B 65/0075; E05B 65/0082; E05B 65/0089; E05B 65/46; E05B 71/00; E05B 77/22; E05B 77/26; E05B 77/54; E05B 81/08; E05B 81/58; E05B 81/76; E05B 81/77; E05B 9/04; E05B 9/042; A47C 19/025; A47C 1/00; A47C 1/024; A47C 1/032; A47C 20/041; A47C 21/044; A47C 21/048; A47C 27/14; A47C 31/008; A47C 3/20; A47J 31/5253; A47J 31/56; A47J 43/046; A47J 43/07; A47J 43/0716; A47J 43/075; A47J 43/0761; A47J 43/085; A61G 5/00; A61G 5/006; A61G 5/10; A61G 5/1005; A61G 5/101; A61G 5/1021; A61G 5/1035; A61G 5/1059; A61G 5/107; A61G 5/12; A61G 5/122; A61G 5/127; A61G 5/14; E05C 17/006; E05C 17/203; E05C 17/36; E05C 3/00; E05C 3/02; E05C 3/042; E05C 9/002; E05C 9/063; E05C 9/1808; E05C 9/185; E05C 9/22; E05C 9/24
See application file for complete search history.

LOCKING MECHANISM AND COOKING MACHINE

CROSS-REFERENCE TO RELATED APPLICATIONS

The present application is based on, and claims priority from, Chinese Patent Application No. 201810155672.8, filed on 23 Feb. 2018, entitled "locking mechanism and a cooking machine", the disclosure of which is hereby incorporated by reference herein in its entirety.

TECHNICAL FIELD

The present invention relates to the field of home appliances, and in particular to a locking mechanism and a cooking machine.

BACKGROUND

With the development of science and technology, cooking machine have more and more influence on the daily life of people.

In the prior art, the technology of heating food by high-temperature is more and more mature, and the cooking machine usually adopts the following heating methods: hot air heating, microwave heating or high-temperature steam heating. Rapid heating on food can be realized in short time by any of the above heat methods.

However, corresponding safety risks may arise while the high-temperature heating technology being widely used. After being heated, the temperature of the food or a vessel therefore is very high, and there is a possibility of being directly in contact with the high-temperature food or vessel without protective measures. In home use, due to insufficient self-protection awareness and strong curiosity, a child may open a door of the cooking machine after the food heating is over, and therefore may be directly in contact with the food or the vessel.

In the prior art, the cooking machine usually has a door of button opening type or pull opening type. The door of pull opening type needs a relatively large power to be opened and thus it is difficult for a child to open such a door, whereas the door of button opening type is simple in operation and can be opened as long as a child of young age can press the button, and therefore there is a possibility for a child to be in contact with the high-temperature food or the vessel.

SUMMARY

The present invention is aimed at providing a locking mechanism and a cooking machine which applies the locking mechanism, and according to the present invention, simpler and more effective locking can be realized, and hence safety of users especially the children can be ensured more effectively.

Specifically, the present invention provides a locking mechanism which is provided on a control panel of the cooking machine and used to control the door-opening button of the cooking machine, and the door-opening button is provided with a door-opening member for opening the door of the cooking machine. The locking mechanism makes the door-opening button selectively in a locked state or an unlocked state, the door will not be opened even if the door-opening button is pressed in the locked state, and the door will be opened if the door-opening button is pressed in the unlocked state.

Compared with the prior art, the locking mechanism provided by the present invention can be switched between a locked state and an unlocked state through a mechanical structure. In the locked state, the locking mechanism blocks a press operation on the door-opening button, so that the door-opening button is in a locked state and the door-opening member cannot further trigger the door-opening mechanism, thus realizing locking of the door. The unlocked state of the locking mechanism can further be divided into a long-term unlocked state and a short-term unlocked state. In the long-term unlocked state, the locking mechanism is in the unlocked state for a long time, so that the door will be opened as long as the door-opening button is pressed. In the short-term unlocked state, the door will not be opened unless the locking mechanism and the door-opening button are operated simultaneously. After the door-opening button is reset, the locking mechanism returns to the locked state again. The locking mechanism of the present invention has the advantages of simple in structure, better in versatility and high in reliability, and can lock the door fundamentally in the door-opening operation, so that simpler and more effective locking can be realized and safety of the users especially the children can be ensured more effectively.

The present invention also provides a cooking machine, and the cooking machine includes the above-described locking mechanisms.

Preferably, the locking mechanism includes a position-limiting member and an eject pin. The position-limiting member is movable in a direction orthogonal to the movement direction of the door-opening member by movement of the eject pin.

According to the above technical solution, the position-limiting member moves in the direction orthogonal to that of the door-opening member along with the movement of the eject pin, thereby implementing control on the door-opening member. Only after the position-limiting member moves to a certain predetermined position, can the door-opening button be pressed and the door-opening mechanism be triggered by the door-opening member to complete the door opening operation. Moreover, when the position-limiting member moves to another predetermined position, and the position-limiting member can be stopped at the position so as to make the locking mechanism stay in the long-term unlocked state. When the position-limiting member is at other positions, the press operation on the door-opening button is blocked, and the door-opening member cannot trigger the door-opening mechanism for being restricted by the position-limiting member, thus realizing the locking of the door. It is possible to control the door to be locked or unlocked by stopping the position-limiting member at the predetermined positions under the action of the eject pin.

Further, the door-opening member is preferably a central guide post provided on the door-opening button, and the position-limiting member is provided with a through hole for allowing the central guide post to pass through.

A normal door-opening step is realized by cooperation of the central guide post and the through hole. After the door-opening button is pressed, the central guide post passes through the through hole to trigger the door-opening mechanism and hence to open the door. The size of the through hole is larger than that of the cross-section of the central guide post, so that it is ensured that the central guide post can pass through the through hole when the locking mechanism is in the unlocked state.

Further, the eject pin preferably includes a paddle and a guide, and the paddle is engaged or disengaged with the guide when the eject pin is pressed.

The guide can guide the paddle to move along a predetermined trajectory, and when the position-limiting member moves to the predetermined positions, the position-limiting member is stopped at the predetermined positions by the engagement between the position-limiting member and the paddle so as to complete the locking and unlocking of the door.

In addition, the eject pin is preferably provided separately from the position-limiting member or a portion of the position-limiting member is designed to act as the guide.

The eject pin can be provided integrally or separately, and the integrally provided eject pin means that a portion of the position-limiting member is designed to act as the guide. Position of the position-limiting member is changed by reciprocation movement of the eject pin. The integrally provided eject pin and the position-limiting members have some common parts, so that the overall size of the locking mechanism is small, thereby saving space. On the contrast, the separately provided eject pin, as a universal part, is provided independently of the position-limiting member and connected therewith, and the eject pin has better versatility for being independently provided.

Further, it is preferred that one end of the paddle is provided with a protrusion and the guide is provided with a projecting portion capable of being engaged or disengaged with the protrusion.

With cooperation between the projecting portion on the guide and the protrusion on the paddle, the protrusion is engaged with the projecting portion so as to stop the position-limiting member at the predetermined positions when the paddle moves to the projecting portion. The eject pin is operated again so as to separate the protrusion from the projecting portion, so that the position-limiting member continues to move.

In addition, it is preferred that the locking mechanism further includes a blocking cover, and the position-limiting member is provided between the blocking cover and the control panel.

The position-limiting member is provided between the blocking cover and the control panel, and the blocking cover is fixed and mounted on the control panel so as to guide and restrict the movement of the position-limiting member, and therefore the position-limiting member is movable in a direction orthogonal to the movement direction of the door-opening member more stably and accurately.

Further, it is preferred that the blocking cover is provided with a notch at a position corresponding to the door-opening member, and the door-opening member can pass through the through hole and the notch in the unlocked state.

The blocking cover itself can protect the position-limiting member, and the notch further provided on the blocking cover at the position corresponding to the door-opening member can restrict and guide the door-opening member, that is the central guide post, to some extent.

In addition, it is preferred that the central guide post is further provided with a spring, and the spring is provided between the door-opening button and the control panel.

The spring mainly acts in a reset process of the door-opening button, and after being pressed by an external force, the door-opening button triggers the door-opening mechanism to open the door. At this time, the spring is pressed, and when the external force is removed, a restoring force of the spring acts on the door-opening button to reset the door-opening button.

DETAILED DESCRIPTION

Hereinafter, the present invention will be described in more detail with reference to the attached drawings.

Overall Configuration of Cooking Machine

Figure 11:
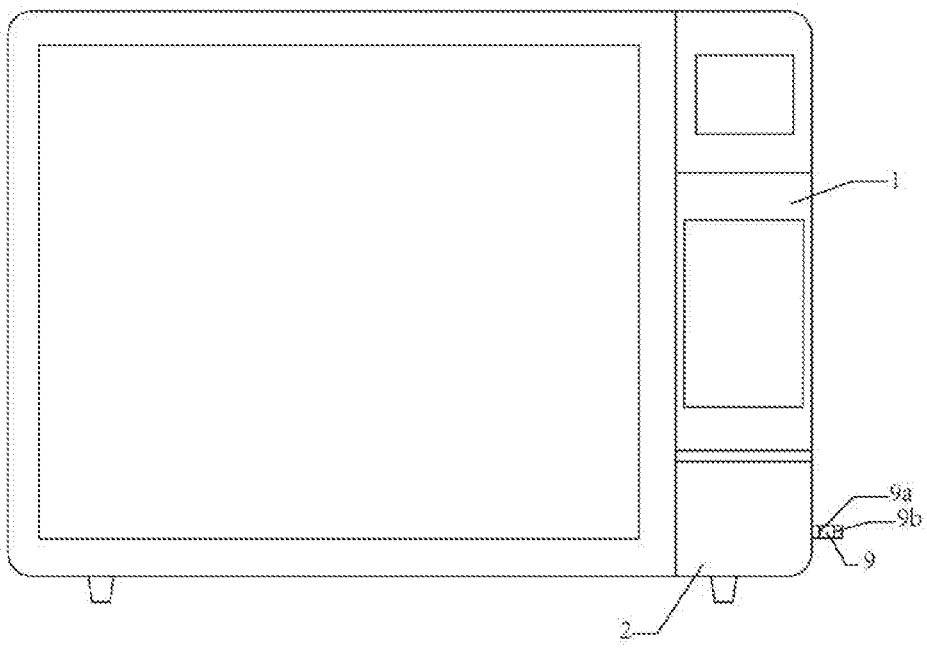
FIG. 11 is a schematic view of a cooking machine of the present invention that is provided with a locking mechanism.

As shown in FIG. 11, the cooking machine of the present invention includes a body and a door. A control panel 1 is provided on a frame of the door and a door-opening button 2 is provided on the control panel 1. When being pressed, the door-opening button 2 triggers a door-opening mechanism (not shown) that is provided on a rear side of the control panel 1 to open the door. The door-opening mechanism is not particularly limited as long as the door-opening mechanism can open the door when being triggered. In the prior art, a door-opening lever may be used as the door-opening mechanism.

Specifically, a door-opening member 5 is provided on the door-opening button 2 and the door-opening member 5 is used to trigger the door-opening mechanism. In the embodiment, the door-opening member 5 passes through a hole provided in the control panel 1 and extends rearward of the control panel 1, and when the door-opening button 2 is pressed, the door-opening member 5 further extends rearward along with the press to trigger the door-opening mechanism and hence to open the door.

In the embodiment, the door-opening member 5 is further provided with a spring 8, and the spring 8 is provided between the door-opening button 2 and the control panel 1.

The spring 8 mainly acts in a reset process of the door-opening button 2, and after being pressed by an external force, the door-opening button 2 triggers the door-opening mechanism to open the door. At this time, the spring 8 is pressed and when the external force is removed, a restoring force of the spring 8 acts on the door-opening button 2 to reset the door-opening button 2.

If the operation on the door-opening button 2 is not limited, a user may open the door at will and get in contact with the food or the vessel in the cooking machine, and when the high-temperature heating is just over, such a behavior may result in that the users especially the children may be in contact with the high-temperature food or vessel. In order to avoid the above-mentioned problem, the present invention provides a locking mechanism.

Configuration of Locking Mechanism

Figure 1:
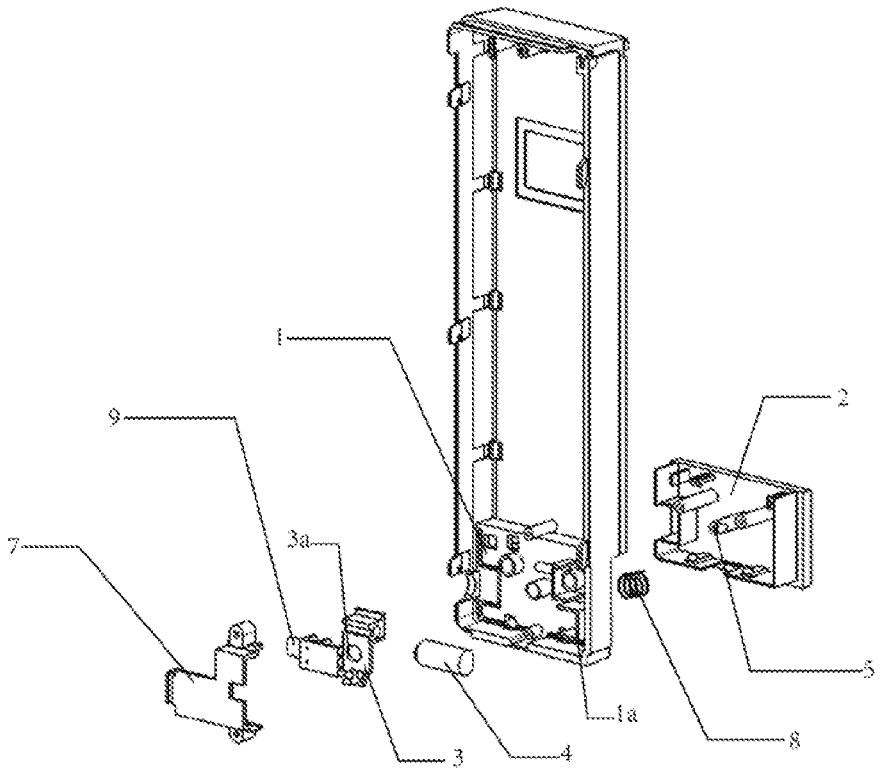
FIG. 1 is a schematic view of various parts of the present invention.
Figure 2:
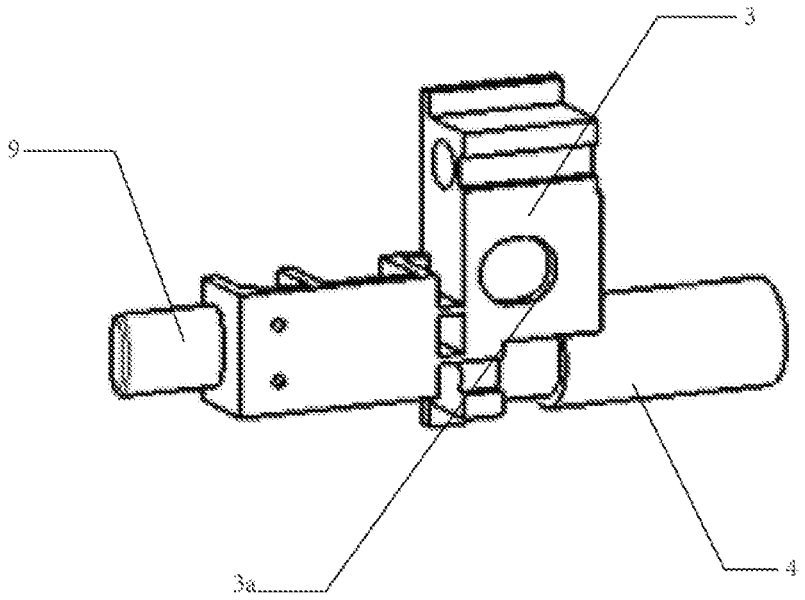
FIG. 2 is a schematic perspective view of a locking mechanism of the present invention.

The locking mechanism of the present invention is provided on the control panel 1 of the cooking machine, as shown in FIGS. 1 and 2, and used to control the door-opening button 2 of the cooking machine. The locking mechanism can be switched among a locked state, a short-term unlocked state, and a long-term unlocked state and accordingly brings the door-opening button 2 selectively to a locked state and an unlocked state, the door cannot be opened even by pressing the door-opening button 2 in the locked state, and the door can be opened by pressing the door-opening button 2 in the unlocked state.

Compared with the prior art, the locking mechanism provided by the present invention blocks the pressing operation on the door-opening button 2 through a mechanical structure, thus locking the door-opening button 2. The door of the cooking machine is locked fundamentally in the door-opening operation, thus realizing simpler and more effective locking and hence ensuring safety of the users especially the children.

Specifically, as shown in FIGS. 1, 2, 3, 6, and 7, the locking mechanism in the embodiment includes a position-limiting member 3 and an eject pin 4. The position-limiting member 3 is movable in a direction orthogonal to the movement direction of the door-opening member 5 by the movement of the eject pin 4.

Configuration of Position-Limiting Member

In brief, the position-limiting member 3 is provided on a movement path of the door-opening member 5, and blocks the press operation on the door-opening button 2. An elastic member 4*c* is provided inside the eject pin 4, and reciprocation movement of the position-limiting member 3 that is orthogonal to the movement direction of the door-opening member 5 is realized by pressing the eject pin 4.

Specifically, the position-limiting member 3 can be moved by pressing the ejector pin 4, and the position-limiting member 3 can be stopped at a preset positional range when the eject pin 4 stops. When the position-limiting member 3 is stopped at an unlocking position, the position-limiting member 3 cannot restrict the movement of the door-opening member 5, so that the door-opening member 5 can trigger the door-opening mechanism to open the door. When the position-limiting member 3 is stopped at a locking position, the position-limiting member 3 is between the door-opening member 5 and the door-opening mechanism, so that the movement of the door-opening member 5 is restricted by the position-limiting member 3 and cannot trigger the door-opening mechanism, as a result the door is locked. The unlocking position of the position-limiting member 3 can be divided into a short-term unlocking position and a long-term unlocking position. When the position-limiting member 3 is stopped at a short-term unlocking region, the door-opening member 5 can trigger the door-opening mechanism, and the position-limiting member 3 can move out of the unlocking positional range after the door is opened, so that the locking mechanism returns to the locked state. When the position-limiting member 3 is stopped at the long-term unlocking position, operation of opening and closing the door does not influence the position of the position-limiting member 3, so that it is ensured that the locking mechanism is in the unlocked state for a long time.

Figure 4:
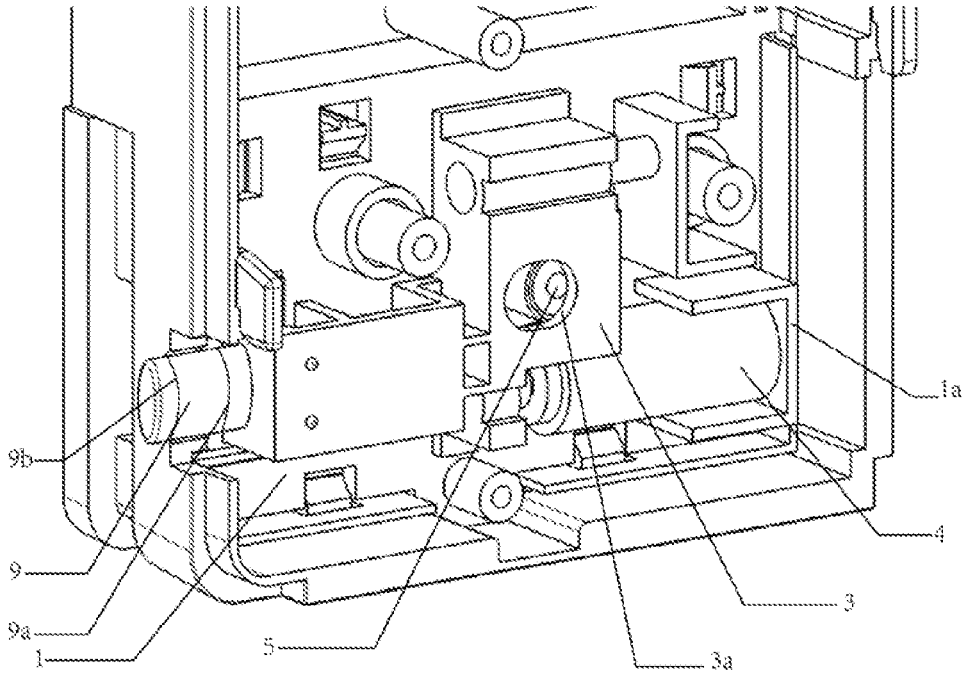
FIG. 4 is a schematic perspective view of the locking mechanism of the present invention in a locked state.
Figure 5:
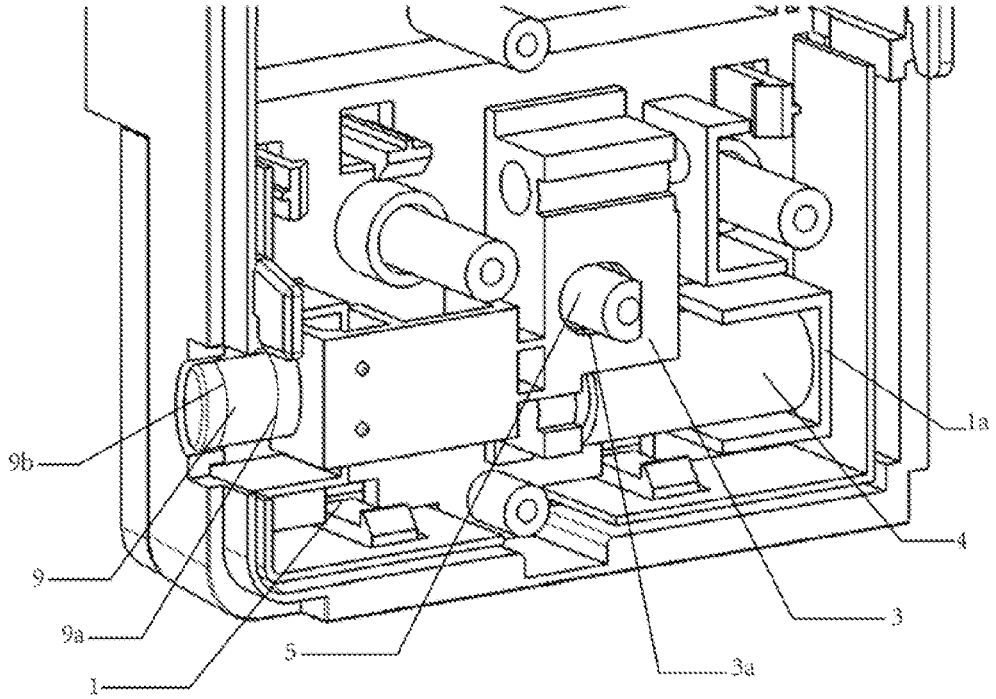
FIG. 5 is a schematic perspective view of the locking mechanism of the present invention in an unlocked state.

With reference to the FIGS. 4 and 5, the position-limiting member 3 is provided with a through hole 3*a* for allowing the door-opening member 5 to pass through. In the embodiment, the door-opening member 5 is a central guide post provided on the door-opening button 2.

When the locking mechanism is not enabled, the position-limiting member 3 is at a long-term unlocking position. At this time, it is ensured that the door-opening member 5 can pass through the through hole 3*a* to trigger the door-opening mechanism after the door-opening button 2 is pressed. When the locking mechanism is enabled, the position-limiting member 3 is at the locking position, and the through hole 3*a* deviates from the door-opening member 5. After the door-opening button 2 is pressed, the door-opening member 5 is blocked by a portion of the position-limiting member 3 which is not the through hole 3*a*, and cannot trigger the door-opening mechanism to complete the locking of the door.

After the locking mechanism is enabled, the position-limiting member 3 is first moved to the short-term unlocking region including the short-term unlocking position when the door is opened, so that the central guide post can pass through the through hole 3*a* in the position-limiting member 3 to trigger the door-opening mechanism. After the door is opened, the central guide post retracts from the through hole 3*a* in the position-limiting member 3 and the position-limiting member 3 is moved out of the short-term unlocking region, so that the locking mechanism is brought to the locked state again.

Specifically, in the embodiment, the through hole 3*a* may be an oblong shape or a rounded rectangle shape, and a major axis direction of the oblong shape coincides with the movement direction of the position-limiting member 3 so as to ensure that the continuous movement is still within the unlocking positional range when the position-limiting member 3 moves to the short-term unlocking position, so that when the central guide post faces a region of the through hole 3*a*, the central guide post can trigger the door-opening mechanism when the door-opening button 2 is pressed. The short-term unlocking position refers to that the central guide post just completely enters the through hole 3*a* in the position-limiting member 3 when the position-limiting member 3 is stopped at the short-term unlocking position (a predetermined position), and the position-limiting member 3 is in the locking positional region until moving to this position; and the long-term unlocking position refers to another position to which the position-limiting member 3 moves from the short-term unlocking position and at which the position-limiting member 3 can be engaged and stopped, the position is referred to as the long-term unlocking position. A region between the long-term unlocking position and the short-term unlocking position is the short-term unlocking region.

Moreover, in order to move the position-limiting member 3 accurately in the direction orthogonal to that of the door-opening member 5, it is necessary to guide and restrict the movement of the position-limiting member 3. In the embodiment, the locking mechanism further includes a blocking cover 7, and the position-limiting member 3 is provided between the blocking cover 7 and the control panel 1.

The blocking cover 7 is provided with mounting holes through which threaded parts passes to fix and mount the blocking cover 7 on the control panel 1, and the position-limiting member 3 is slidably provided therebetween. The fixed blocking cover 7 can define a movement space for the position-limiting member 3, while protecting the position-limiting member 3, so that the service life of the locking mechanism is prolonged.

Preferably, in the embodiment, the blocking cover 7 is provided with a notch 7*a* at a position corresponding to the door-opening member 5. In the unlocked state, the door-opening member 5 can pass through the through hole 3*a* and the notch 7*a* to trigger the door-opening mechanism.

Configuration and Movement of Eject Pin

In the embodiment, the eject pin 4 has two configurations: the eject pin 4 and the position-limiting member 3 are integrally provided or the eject pin 4 is provided separately from the position-limiting member 3, herein "integrally provided" means that a portion of the position-limiting member 3 is used as a guide of the eject pin 4, and the two configurations will be described below.

Figure 3:
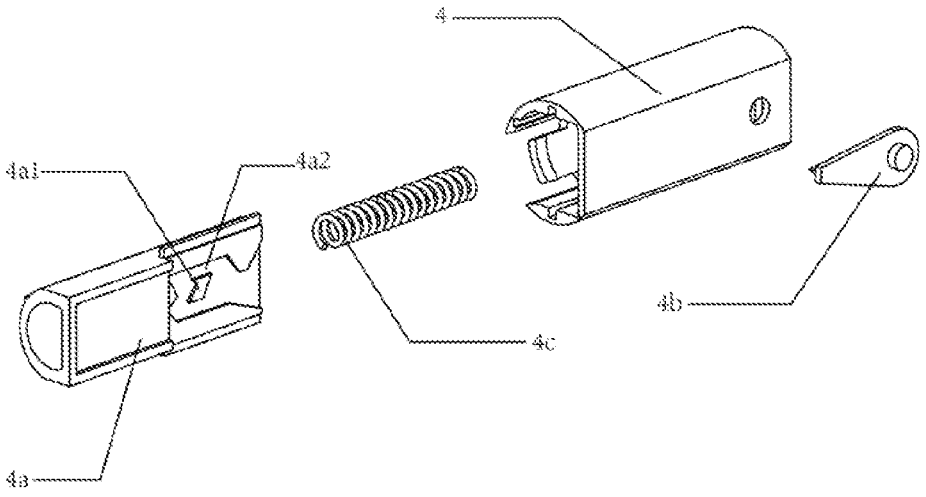
FIG. 3 is an exploded view of an eject pin of the locking mechanism.

First the method of providing the eject pin 4 separately will be described. As shown in FIGS. 1, 3, and 4, the eject pin 4 of the locking mechanism of the present invention is in close contact with the control panel 1 and is provided on a lateral side of the position-limiting member 3. The eject pin 4 is connected with the position-limiting member 3 so as to realize the interlock therebetween. The eject pin 4 includes a paddle 4*b* and a guide 4*a*, and the paddle 4*b* can be engaged or disengaged with the guide 4*a* when the eject pin 4 is pressed.

Figure 9:
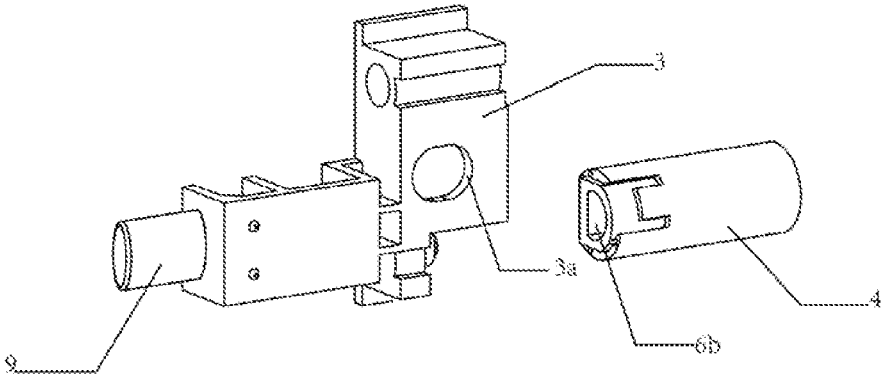
FIG. 9 is an exploded view of a locking mechanism of the present invention that is provided separately.
Figure 10:
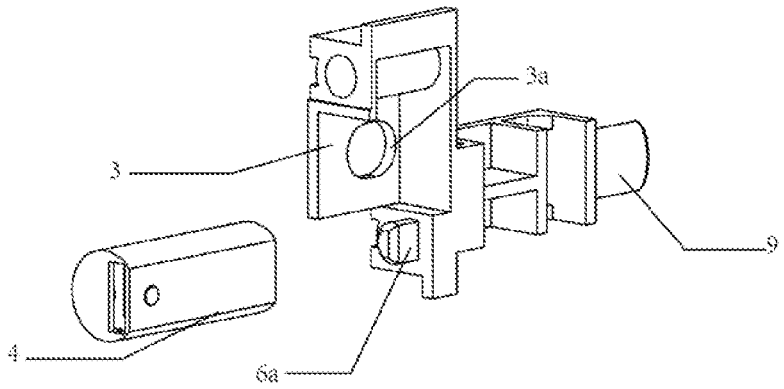
FIG. 10 is another exploded view of the locking mechanism of the present invention that is provided separately.

As shown in FIGS. 9 and 10, since it is necessary for the eject pin 4 to be in close contact with the control panel 1, a cross-section of the eject pin 4 may be a D shape considering stable mounting. A plane surface of the eject pin 4 is in contact with the control panel 1, so that the housing of the eject pin 4 can be positioned and mounted more firmly. The guide 4*a* inside the eject pin 4 may also adopt a D-shaped cross-section so as to match with the housing of the eject pin 4. The guide 4*a* is provided with a D-shaped hole 6*b* on a side that is connected with the position-limiting member 3 and the position-limiting member 3 is provided with a D-shaped shaft 6*a* so as to match and connect with the eject pin 4. Of course, the position-limiting member 3 can also be provided with a hole and the guide can also be provided with a shaft. The cross-section of the eject pin 4 is not limited to the D shape as long as one side of the eject pin 4 can be in close contact with the control panel 1 and there is no particular limit to the shape of the other side thereof. The connection method is not particular limited as long as the position-limiting member 3 and the eject pin 4 can be connected.

Further, in the embodiment, the control panel 1 is further provided with a fixing slot 1*a* for fixing the eject pin 4, as shown in FIGS. 4 and 5. The fixing slot 1*a* ensures that the eject pin 4 is not displaced when pressing the position-limiting member 3, thus ensuring that the eject pin 4 can function reliably.

The guide 4*a* is provided with a recessed portion 4*a*2 and a projecting portion 4*a*1 is formed in the recessed portion 4*a*2. The paddle 4*b* is provided with a protrusion 4*b*1 on one end thereof. The projecting portion 4*a*1 can be engaged or disengaged with the protrusion 4*b*1, and therefore a part of the recessed portion 4*a*2 surrounding the projecting portion 4*a*1 forms a predetermined trajectory which is a path for movement of the paddle 4*b*. It is ensured that the paddle 4*b* moves along the predetermined trajectory of the guide 4*a* by cooperation of guide 4*a* and the paddle 4*b*. More specifically, the predetermined trajectory in the embodiment is a groove-shaped track, and the protrusion 4*b*1 of the paddle 4*b* is movable in a way of being engaged with the track.

The restriction of the groove-shaped track on the protrusion 4*b*1 can ensure that the paddle 4*b* moves along the predetermined trajectory. In addition, the matching between the paddle 4*b* and the guide 4*a* is more reliable by the engagement between the track and the protrusion 4*b*1. Thus, the influence of different operating conditions on the eject pin 4 is reduced, so that the eject pin 4 has better versatility.

More specifically, the guide 4*a* can be provided independently and another end of the paddle 4*b* can be rotatably provided in the housing of the eject pin 4 via a pin. When the eject pin 4 is pressed, the guide 4*a* moves in a direction orthogonal to that of the door-opening member 5, so that the other end of the paddle 4*b* is rotated around the pin, as a result, one end of the paddle 4*b* slides along the predetermined trajectory of the guide 4*a*.

The guide 4*a* can guide the paddle 4*b* to move along the predetermined trajectory, and when the position-limiting member 3 moves to the predetermined positions, the position-limiting member 3 can be stopped at the predetermined positions by cooperation between the position-limiting member 3 and the paddle 4*b* so as to complete the locking and unlocking of the door.

The engagement between the protrusion 4*b*1 on the paddle 4*b* and the projecting portion 4*a*1 is mainly used to position the position-limiting member 3. When the position-limiting member 3 is at the locking position, the protrusion 4*b*1 is just engaged with the projecting portion 4*a*1 of the guide 4*a*. When the protrusion 4*b*1 is disengaged with or separated from the projecting portion 4*a*1, the paddle 4*b* returns to an initial position along the predetermined trajectory. The guide 4*a* is further provided with an elastic member 4*c* therein, and the elastic member 4*c* is provided to apply a force on the guide 4*a* in a direction towards the position-limiting member 3 so as to reset the eject pin 4.

In the embodiment, the position-limiting member 3 is further provided with a tab 9 on a side opposite the eject pin 4 and the tab 9 is used to operate the eject pin 4.

Hereinafter, movement of the eject pin 4 will be described. When the tab 9 is pressed, the position-limiting member 3 accordingly moves and movement of the position-limiting member 3 is transmitted to the guide 4*a*. The guide 4*a* moves in a direction orthogonal to the movement direction of the door-opening member 5, so that the guide 4*a* and the paddle 4*b* move relative to each other and the protrusion 4*b*1 on the paddle 4*b* moves in a direction approaching the projecting portion 4*a*1 along the predetermined trajectory. When the tab 9 is pressed to a certain position, the position-limiting member 3 is in a short-term unlocking position or a short-term unlocking region that is between the long-term unlocking position and the short-term unlocking position, and at this time the door-opening member 5 can pass through the through hole 3*a* in the position-limiting member 3 to trigger the door-opening mechanism by pressing the door-opening button 2 while pressing the tab 9; and thereafter the door-opening button 2 is reset under the action of the spring 8, the door-opening member 5 is retracted from the through hole 3*a* in the position-limiting member 3, and at the same time the eject pin 4 drives the position-limiting member 3 to return to the locking positional region from the unlocking positional region under the action of the elastic member 4*c*.

When the position-limiting member 3 is at a short-term unlocking region, the tab 9 is further pressed and the position-limiting member 3 accordingly moves in the direction towards the projecting portion 4*a*1 until the projecting portion 4*a*1 on the guide 4*a* matches with the protrusion 4*b*1 on the paddle 4*b* and the protrusion 4*b*1 is engaged with the projecting portion 4*a*1, and thus the position-limiting member 3 is stopped at the predetermined position. At this time, the position-limiting member 3 is at a long-term unlocking position and the door-opening member 5 is at a region facing the through hole 3*a*, so that the door-opening member 5 can pass through the through hole 3*a* and trigger the door-opening mechanism after the door-opening button 2 is pressed. After the door is opened, the door-opening button 2 is reset under the action of the spring 8 and the position-limiting member 3 stays at the long-term unlocking position. Since the projecting portion 4*a*1 and the protrusion 4*b*1 are engaged with each other and the elastic member 4*c* cannot reset the eject pin 4. In this state, the locking mechanism is non-enabled and is in the long-term unlocked state.

When the position-limiting member 3 is at the long-term unlocking position, the protrusion 4*b*1 of the paddle 4*b* is separated from the projecting portion 4*a*1 of the guide 4*a* by further pressing the tab 9, and the eject pin 4 drives the position-limiting member 3 to move from the unlocking positional region to the locking positional region under the action of the elastic member 4*c*. After the door-opening button 2 is pressed, the door-opening member 5 is blocked by a portion of the position-limiting member 3 which is not the through hole 3*a*, so that the door-opening member 5 cannot trigger the door-opening mechanism to complete the locking of the door. At this time, the locking mechanism in such a state is in an enabled state.

Preferably, in the embodiment, corresponding marks can be provided on the tab 9 to make the user more visually understand the position where the position-limiting member 3 is located.

As shown in FIGS. 4, 5 and 11, the marks may be scale lines provided on the tab 9. Specifically, there are two scale lines which are provided around whole periphery of a cylindrical body of the tab 9, and a scale line close to the cooking machine is a first scale 9*a* and a scale line away from the cooking machine is a second scale 9*b*. When the position-limiting member 3 moves to the short-term unlocking position, the first scale 9*a* is just aligned with the housing of the cooking machine. When the position-limiting member 3 moves to the long-term unlocking position, the first scale 9*a* is outside of the housing of the cooking machine and the second scale 9*b* is aligned with the cooking machine. Besides the scale lines, other marks that can be visually observed by the user can also be used.

Moreover, in the embodiment, a shape of the protrusion 4*b*1 on the paddle 4*b* is a triangular prism, and the shape of the projecting portion 4*a*1 corresponds to that of the protrusion 4*b*1. For example, one side of the projecting portion 4*a*1 can be formed into a wedge shape.

The wedge-shaped part of the projecting portion 4*a*1 is engaged with two edges of the triangular-prism-shaped protrusion 4*b*1, so that the two portions are firmly engaged with each other and hence the position-limiting member 3 is stopped at the unlocking position or the locking position more stably.

In a method of providing the eject pin 4 separately, the eject pin 4 may be connected with the position-limiting member 3 by a universal part, so that the installation ways are more varied, and the versatility is better.

Figure 6:
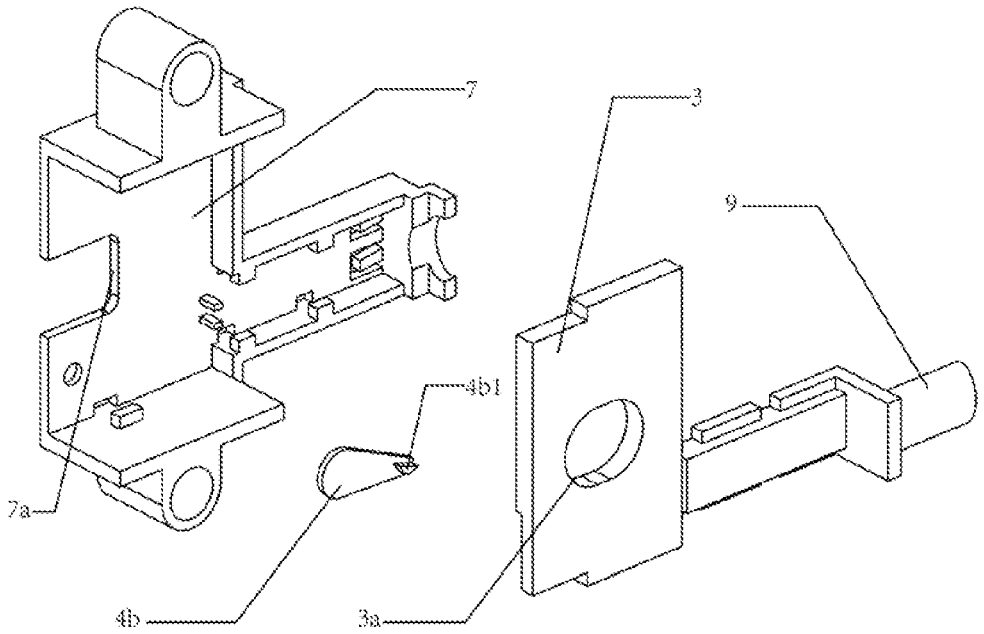
FIG. 6 is an exploded view of a locking mechanism of the present invention that is provided integrally.
Figure 7:
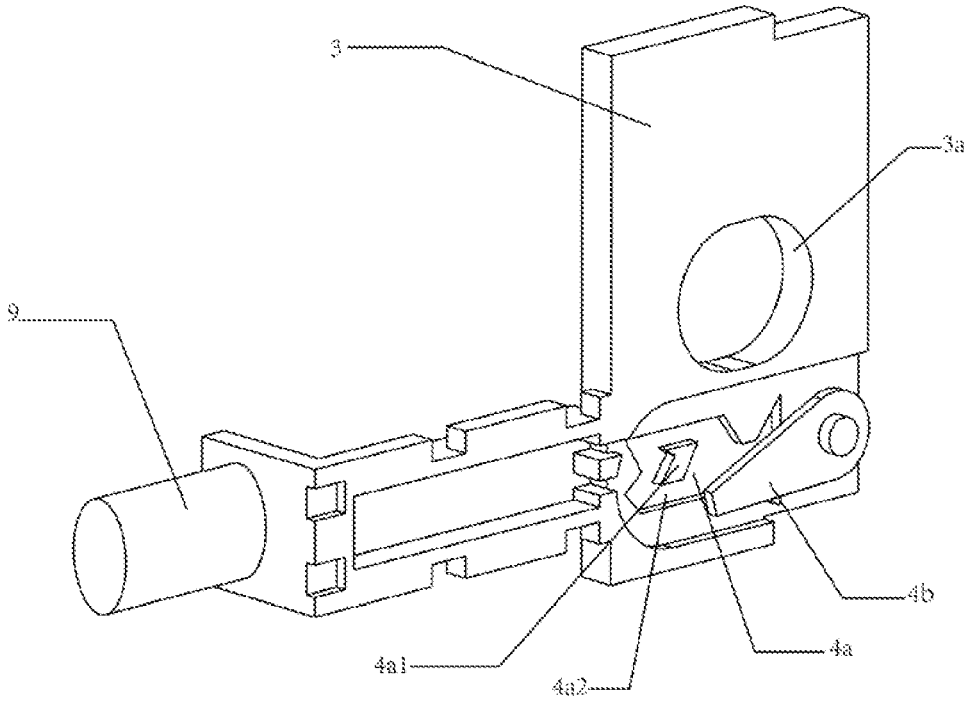
FIG. 7 is a schematic perspective view of the locking mechanism of the present invention that is provided integrally.
Figure 8:
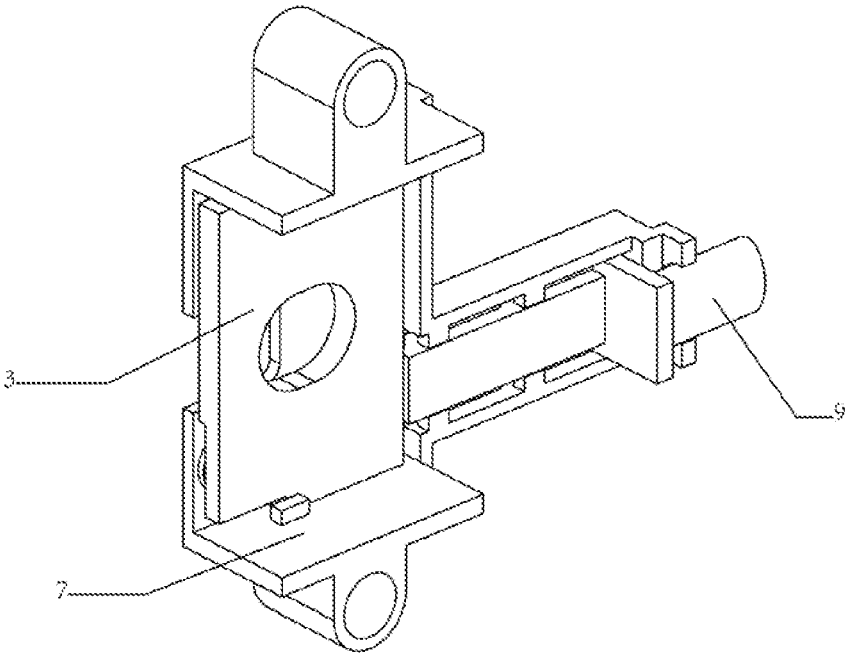
FIG. 8 is another schematic perspective view of the locking mechanism of the present invention that is provided integrally.

Next, a method of providing the eject pin integrally will be described. FIGS. 6 and 7 show various parts of the locking mechanism when the eject pin is integrally provided, and FIG. 8 shows the overall configuration of the locking mechanism when the eject pin is integrally provided.

In brief, when the ejector pin 4 is integrally provided, a portion of the position-limiting member 3 is used as the ejector pin 4 so as to reduce an overall volume of the locking mechanism and spare enough space for installation of other parts on the control panel 1.

Specifically, a portion of the position-limiting member 3 is formed as the guide 4*a*, and since the configuration of the guide 4*a* is the same as that in the case where the eject pin is provided separately, the description thereof is omitted here. The blocking cover 7 is provided with mounting holes at corresponding positions thereof, and the paddle 4*b* is hinged to the blocking cover 7 via a pin. The protrusion 4*b*1 at one end of the paddle 4*b* is engaged with the groove-shaped track of the guide 4*a*, thus ensuring that the paddle 4*b* can move along a predetermined trajectory defined by the groove-shaped track. The paddle 4*b* is provided between the blocking cover 7 and the position-limiting member 3, so that the close engagement between the paddle 4*b* and the position-limiting member 3 can be ensured, and hence the locking effect of the locking mechanism can be guaranteed. Between the position-limiting member 3 and the blocking cover 7, an elastic member (not shown) is further provided for returning the position-limiting member 3 to the initial position.

Hereinafter, the movement of the eject pin 4 will be described. When the tab 9 is pressed, the position-limiting member 3 accordingly moves, and the guide 4*a* that is integrally formed with the position-limiting member 3 moves in a direction orthogonal to the movement direction of the door-opening member 5, so that the guide 4*a* and the paddle 4*b* move relative to each other and the protrusion 4*b*1 on the paddle 4*b* move in a direction approaching the projecting portion 4*a*1 along the predetermined trajectory. When the position-limiting member 3 moves to the short-term unlocking region, the position-limiting member 3 returns to the locking positional region under the action of the ejecting pin 4 after the door opening operation is completed, so that the locking mechanism is switched to the locked state again. When the tab 9 is pressed beyond a position of the short-term unlocking region, the protrusion 4*b*1 on the paddle 4*b* is engaged with the protrusion 4*a*1 on the guide 4*a* by the cooperation between the protrusion 4*a*1 and the protrusion 4*b*1 so as to stop the position-limiting member 3 at the long-term unlocking position, so that the position-limiting member 3 is in the unlocked state for a long time. When the position-limiting member 3 needs to be switch to the locked state, the tab 9 is further pressed so that the guide 4*a* further moves towards the paddle 4*b*. At this moment, the protrusion 4*b*1 is disengaged with the protruding portion 4*a*1 and the eject pin 4 is reset by the elastic member, so that the position-limiting member 3 returns to the locking positional region.

In short, in the present invention, the position of the position-limiting member 3 is changed by the reciprocation movement of the ejector pin 4, thus realizing switching between the locked state and the unlocked state.

The cooking machine provided by the present invention includes the locking mechanism as described above, and the locking mechanism is provided at the door-opening button 2 of the cooking machine. The position-limiting member and the eject pin of the locking mechanism has been described with various embodiments, and these embodiments can be freely combined without departing from the principle of the present invention.

Compared with the prior art, the cooking machine provided by the invention includes a locking mechanism for the door, and the door can be locked as needed. In addition, the method for locking the door of the cooking machine in the present invention is to restrict the movement of the door-opening button 2 and the door-opening member 5 so as to prevent the door-opening mechanism from being triggered, thus locking the door by locking the door-opening button 2. According to the present invention, the door can be locked fundamentally in the door-opening operation, thus realizing simpler and more effective locking and hence ensuring safety of the users especially the children more effectively.

It should be understood by those skilled in the art that in the above embodiments, many technical details are proposed in order to provide the readers with better understanding of the present application. However, the technical solutions claimed in the claims of the present application can basically be implemented without these technical details and various changes and modifications based on the above embodiments. Thus, in the practical application, various changes can be made in form and details of the above-described embodiments without departing from the spirit and scope of the invention.

DESCRIPTION OF REFERENCE NUMERALS

1 control panel
1*a* fixing slot
2 door-opening button
3 position-limiting member
3*a* through hole
4 eject pin
4*a* guide
4*a*1 projecting portion
4*a*2 recessed portion
4*b* paddle
4*b*1 protrusion
4*c* elastic member
5 door-opening member
6*a* D-shaped shaft
6*b* D-shaped hole
7 blocking cover
7*a* notch
8 spring
9 tab
9*a* first scale
9*b* second scale

The invention claimed is:

1. A locking mechanism for a control panel of a cooking machine to control a door-opening button of the cooking machine, the door-opening button being provided with a door-opening member for opening a door of the cooking machine, wherein the locking mechanism comprises:

a locked state and an unlocked state, wherein the locking mechanism is selectively switchable between the locked state, in which the door cannot be opened even if the door-opening button is pressed in the locked state, and the unlocked state, in which the door can be opened if the door-opening button is pressed in the unlocked state;

a position-limiting member; and an eject pin which comprises a paddle and a guide, wherein the paddle is engaged or disengaged with the guide when the eject pin is pressed, and wherein the position-limiting member is movable in a direction orthogonal to a movement direction of the door-opening member by movement of the eject pin.

2. The locking mechanism according to claim 1, wherein the door-opening member comprises a central guide post provided on the door-opening button, and the position-limiting member is provided with a through hole for allowing the central guide post to pass through.

3. The locking mechanism according to claim 1, wherein the eject pin and the position-limiting member are provided separately or a portion of the position-limiting member acts as the guide.

4. The locking mechanism according to claim 3, wherein the paddle is provided with a protrusion on one end thereof, and the guide is provided with a projecting portion that is capable of being engaged or disengaged with the protrusion.

5. The locking mechanism according to claim 1 further comprising:

a blocking cover, wherein the position-limiting member is provided between the blocking cover and the control panel.

6. The locking mechanism according to claim 2, wherein the central guide post is further provided with a spring, and the spring is provided between the door-opening button and the control panel.

7. A cooking machine comprising:

a door;

a control panel;

a door opening button provided with a door-opening member for opening the door; and a locking mechanism comprising:

a locked state and an unlocked state, wherein the locking mechanism is selectively switchable between the locked state, in which the door cannot be opened even if the door-opening button is pressed in the locked state, and the unlocked state, in which the door can be opened if the door-opening button is pressed in the unlocked state;

a position-limiting member; and an eject pin which comprises a paddle and a guide, wherein the paddle is engaged or disengaged with the guide when the eject pin is pressed, and wherein the position-limiting member is movable in a direction orthogonal to a movement direction of the door-opening member by movement of the eject pin.

8. A locking mechanism for a control panel of a cooking machine to control a door-opening button of the cooking machine, the door-opening button being provided with a door-opening member for opening a door of the cooking machine, wherein the locking mechanism comprises:

a locked state and an unlocked state, wherein the locking mechanism is selectively switchable between the locked state, in which the door cannot be opened even if the door-opening button is pressed in the locked state, and the unlocked state, in which the door can be opened if the door-opening button is pressed in the unlocked state;

a position-limiting member, which has a through hole;

an eject pin, wherein the position-limiting member is movable in a direction orthogonal to a movement direction of the door-opening member by movement of the eject pin; and a blocking cover, wherein the position-limiting member is provided between the blocking cover and the control panel, and wherein the blocking cover is provided with a notch at a position corresponding to the door-opening member, and the door-opening member is capable of passing through the through hole and the notch in the unlocked state.

* * * * *